US011553747B1

(12) United States Patent
Mondy

(10) Patent No.: US 11,553,747 B1
(45) Date of Patent: Jan. 17, 2023

(54) INFLATABLE GARMENT ACCESSORY

(71) Applicant: Kertious Mondy, Miami, FL (US)

(72) Inventor: Kertious Mondy, Miami, FL (US)

( * ) Notice: Subject to any disclaimer, the term of this patent is extended or adjusted under 35 U.S.C. 154(b) by 31 days.

(21) Appl. No.: 17/347,724

(22) Filed: Jun. 15, 2021

Related U.S. Application Data

(60) Provisional application No. 63/039,066, filed on Jun. 15, 2020.

(51) Int. Cl.
*A41D 27/08* (2006.01)

(52) U.S. Cl.
CPC ..... *A41D 27/08* (2013.01)

(58) Field of Classification Search
CPC .. A41D 27/08; A41D 13/0155; A41D 13/018; A41D 2600/102; A41D 2600/104; A41D 2400/14; A41D 13/0025; Y10S 2/03; B64D 10/00; B64D 23/00; A63B 23/047; A63B 2225/62; A63H 3/06
USPC ..... 244/110, 143
See application file for complete search history.

(56) References Cited

U.S. PATENT DOCUMENTS 4,984,821 A * 1/1991 Kim ..... B60R 21/01 2/455
5,048,123 A * 9/1991 Monson ..... A41D 27/08 446/28
5,079,778 A 1/1992 Sloot
5,813,051 A * 9/1998 Counter ..... G09F 21/02 2/108
5,933,866 A 8/1999 Fox
2008/0178370 A1* 7/2008 Orita ..... A41D 13/018 2/455
2012/0023648 A1* 2/2012 Dainese ..... A41D 1/00 2/463
2016/0073707 A1* 3/2016 Ronco ..... A41D 13/018 2/463
2019/0216150 A1* 7/2019 Parkinson ..... A63B 21/4011

* cited by examiner

*Primary Examiner* — Katherine M Moran
*Assistant Examiner* — Grady Alexander Nunnery
(74) *Attorney, Agent, or Firm* — Sanchelima & Associates, P.A.; Christian Sanchelima; Jesus Sanchelima

(57) ABSTRACT

An inflatable garment accessory including a body assembly and a sleeve assembly is disclosed. The body assembly includes an inflatable member that is made of a cloth material and has an interior space therein. The inflatable member may be rectangular in shape and further includes a font end. A user may then place indicia and/or designs to be accentuated on the front end of the inflatable member. The sleeve assembly includes two sleeve members made of cloth material that are mounted to opposite perimeter sides of the inflatable member. The two sleeve members form a tunnel which receive air therein. The air then inflates the inflatable member which in turn accentuates the indicia and/or design located at the front end.

8 Claims, 4 Drawing Sheets

INFLATABLE GARMENT ACCESSORY

OTHER RELATED APPLICATIONS

The present application is a U.S. Non-Provisional Patent application claiming priority of U.S. Provisional Patent Application Ser. No. 63/039,066 filed on Jun. 15, 2020, which is hereby incorporated by reference.

FIELD OF THE INVENTION

The present invention relates to a garment accessory and, more particularly, to a garment accessory that is stitched on to an existing piece of clothing and then inflated to accentuate an indicia and/or design.

DESCRIPTION OF THE RELATED ART

Several designs for a garment accessory have been designed in the past. None of them, however, include an inflatable garment accessory including a body assembly and a sleeve assembly. The body assembly includes an inflatable member that is made of a cloth material and has an interior space therein. The inflatable member may be rectangular in shape and further includes a font end. A user may then place indicia and/or designs to be accentuated on the front end of the inflatable member. The sleeve assembly includes two sleeve members made of cloth material that are mounted to opposite perimeter sides of the inflatable member. The two sleeve members form a tunnel which receive air therein. The air then inflates the inflatable member which in turn accentuates the indicia and/or design located at the front end. It is known that individuals who are involved in professional sports often have the need to display the logo or indicia of their sponsors on their uniform. It is also known that the traditional way of displaying these indicia/designs often do not catch a user's attention when imprinted on a logo. Therefore, there is a need for an inflatable garment accessory that is stitched onto an existing piece of clothing. The garment accessory includes an indicia and/or design that is accentuated when the garment is inflated. As a result, a user may more effectively grab people's attention when preforming outdoor activities or professional sports. In a preferred setting, the garment accessory is used by a motorcycle driver when driving their motorcycle.

Applicant believes that a related reference corresponds to U.S. Pat. No. 5,079,778 issued for an inflatable applique for an article of clothing which includes a valved and substantially airtight enclosure having a top layer and a backing layer with complementary peripheral outlines. Applicant believes that another related reference corresponds to U.S. Pat. No. 5,933,866 issued for a novelty apparel having a two-dimensional design imprinted thereon and a somewhat flexible three-dimensional revvable portion of the design which represents a prominent portion of the design. However, the cited references differ from the present invention because they fail to disclose an inflatable garment accessory having a body assembly and a sleeve assembly. The accessory is stitched on to an existing piece of clothing to be inflated by the sleeves attached thereon. The cited references fail to disclose the novel configuration of the present invention.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an inflatable garment accessory which provides an effective method for accentuating indicia and/or designs etched thereon.

It is another object of this invention to provide an inflatable garment accessory which may be attached in various configurations to an existing piece of clothing.

It is still another object of the present invention to provide an inflatable garment accessory which is easy to use and further provides an effective marketing means.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
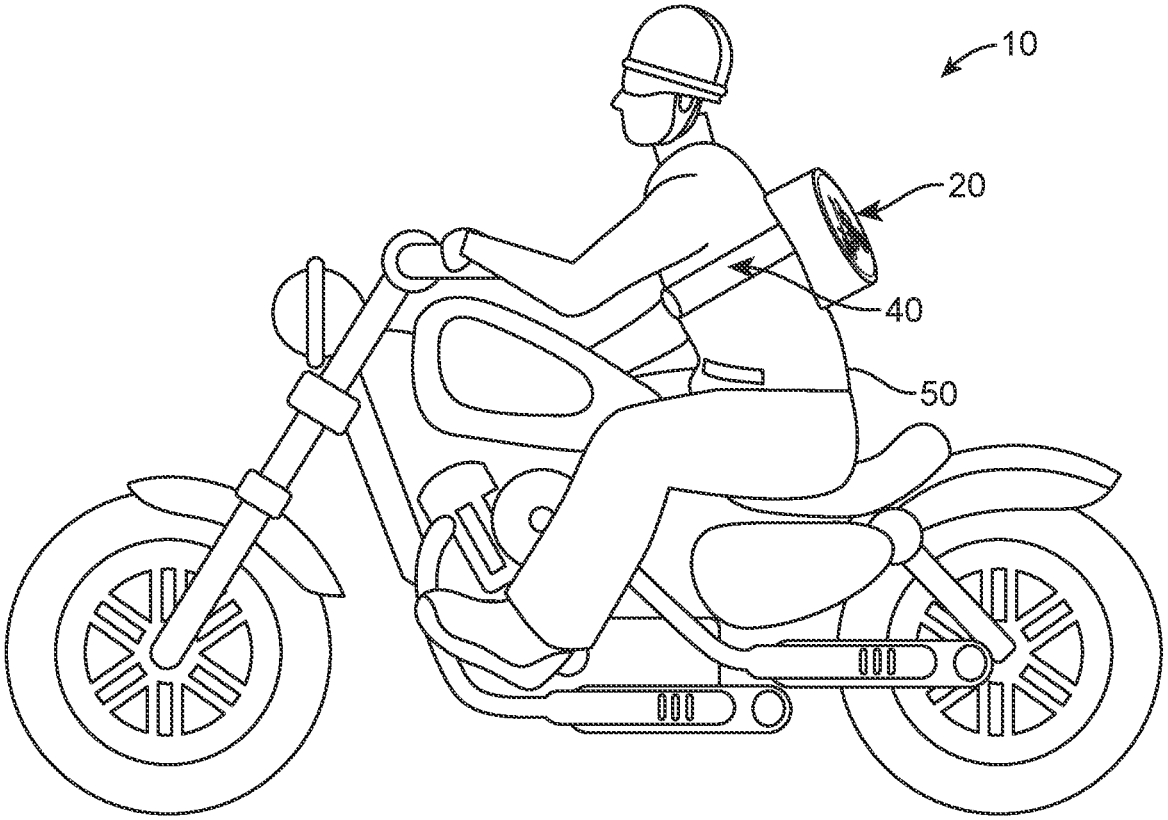
FIG. 1 represents an operational isometric view of inflatable garment accessory 10 in accordance with an embodiment of the present invention.
Figure 2:
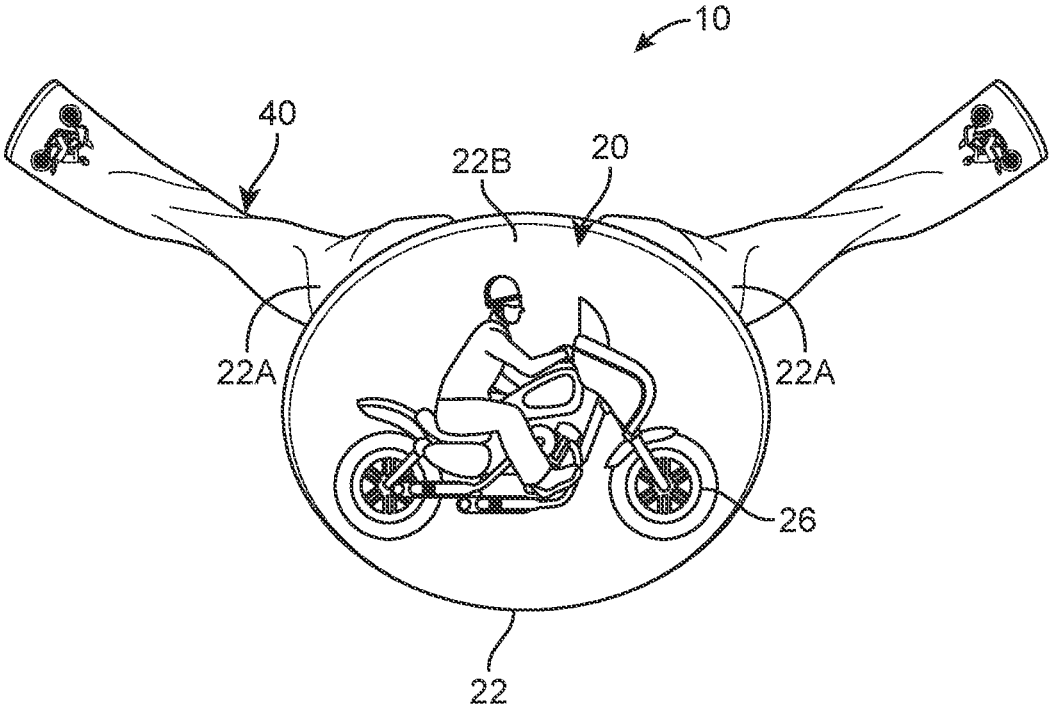
FIG. 2 shows a front view of inflatable garment accessory 10 in accordance with an embodiment of the present invention.
Figure 3:
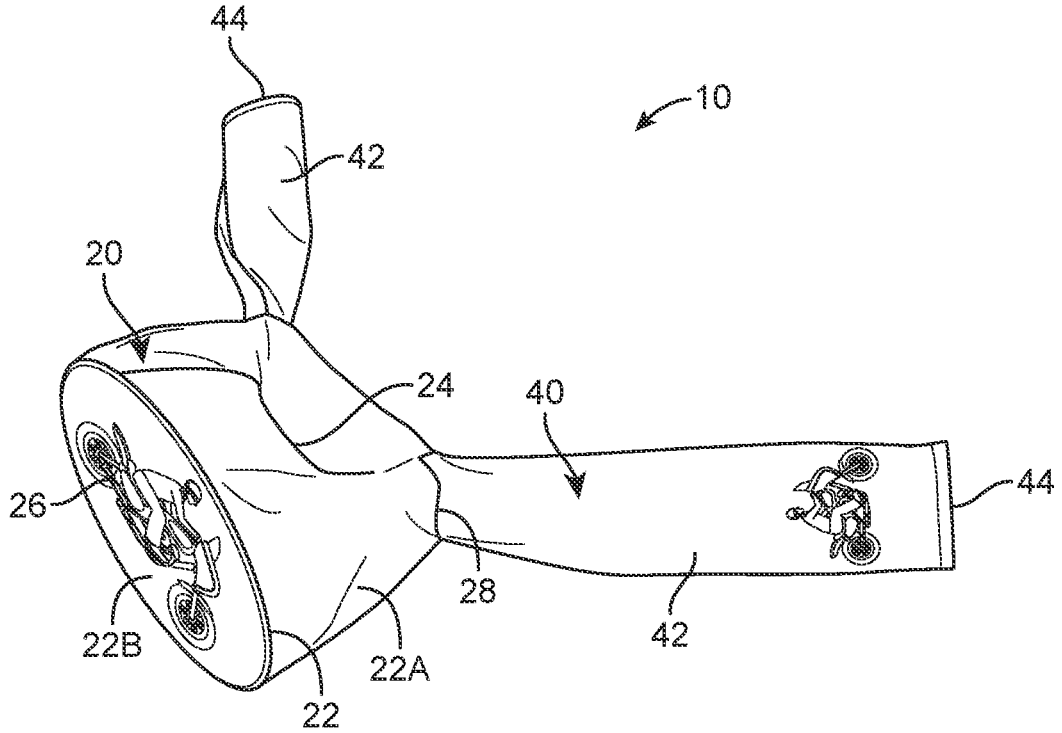
FIG. 3 illustrates a left side view of inflatable garment accessory 10 in accordance with an embodiment of the present invention.
Figure 4:
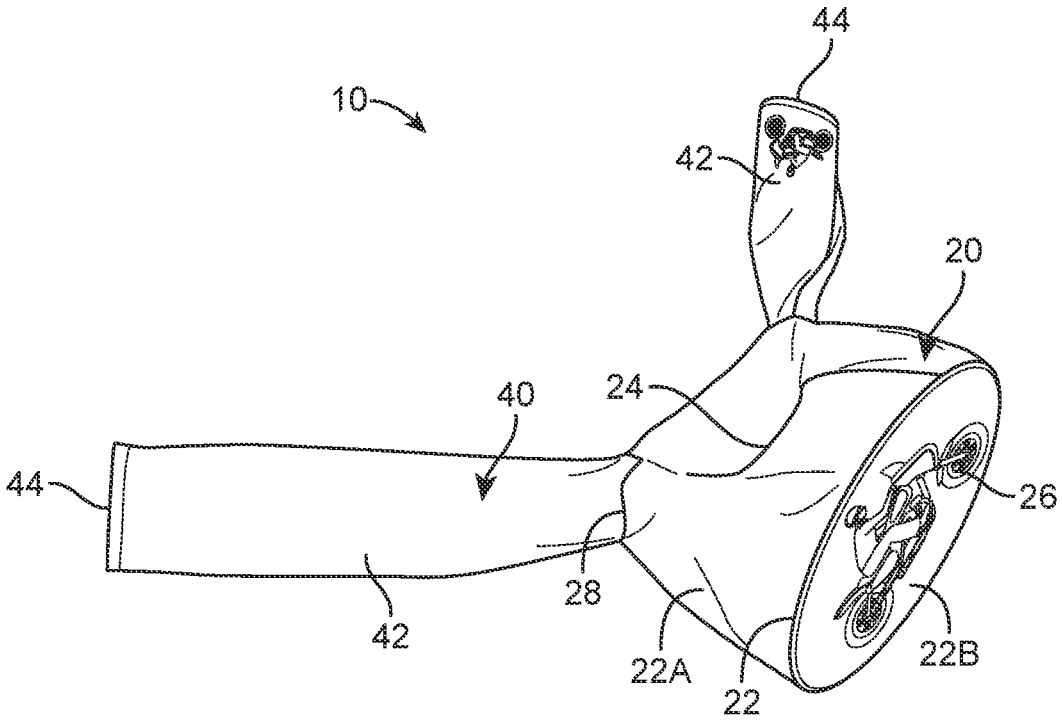
FIG. 4 is a representation of a right side view of inflatable garment accessory 10 in accordance with an embodiment of the present invention.
Figure 5:
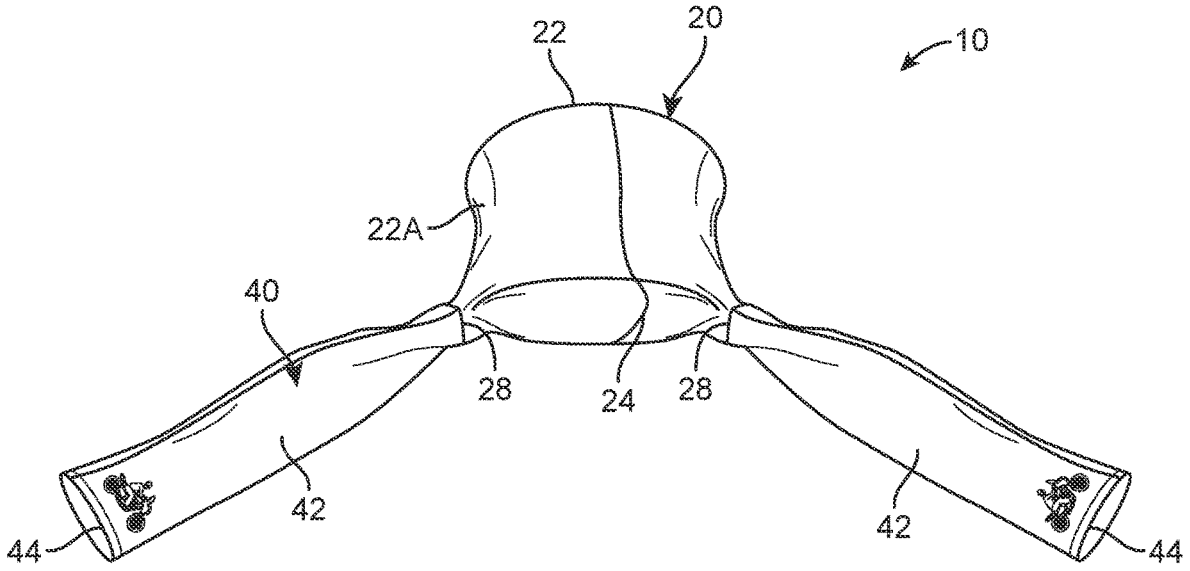
FIG. 5 shows a rear view of the inflatable garment accessory 10 in accordance with an embodiment of the present invention.
Figure 6:
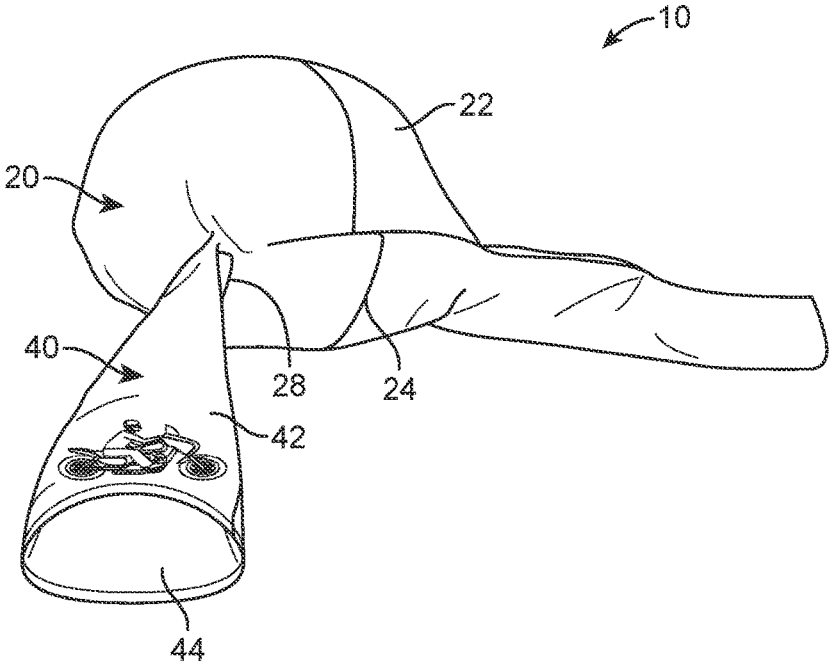
FIG. 6 illustrates an enlarged view of sleeve assembly 40 in accordance with an embodiment of the present invention.

Referring now to the drawings, where the present invention is generally referred to with numeral 10, it can be observed an inflatable garment accessory 10 which basically includes a body assembly 20 and a sleeve assembly 40.

Body assembly 20 includes a inflatable member 22 having perimeter sides 22A and a front end 22B. In the present embodiment, inflatable member 22 is configured to be stitched on to an existing piece of clothing 50. In one embodiment, clothing 50 may be provided in the form of a shirt. Inflatable member 22 may then be mounted onto the front end or back end of the shirt. Other embodiments may feature inflatable member 22 mounted onto other various forms of clothing 50 such as pants or a hat. In one implementation, inflatable member 22 may be made of a stretchable cloth material. This stretchable cloth material allows inflatable member 22 to be inflated safely and will not break. Other implementations may feature inflatable member 22 made of additional materials or combinations thereof such as latex or spandex. Inflatable member 22 may further include an interior space 24 therein. Interior space 24 represents an inner area of inflatable member 22 that receives air therein. Once interior space 24 begins to be filled within air, inflatable member 22 will then begin to inflate and thereby accentuates front end 22B. Furthermore, inflatable member 22 may be provided as an airtight inflatable member so as to not let any air from within the inflatable member to escape.

Body assembly 20 further includes an indicia and/or design 26 that is imprinted onto front end 22B of inflatable member 22. In one embodiment, this indicium may be the indicia of a company or a personal quote. This indicium 26 may be any suitable written words a user would like to be accentuated. In another embodiment, front end 22B does not include any indicia and only includes a design. The design provided may be in the form of a personal pattern or drawing or even a logo by a company. Design 26 may be any suitable form of visual media that can be imprinted onto front end 22B. Indicia and/or design 26 becomes accentuated once inflatable member 22 fills with air and transitions into an inflated state. Other embodiments of the present invention may omit indicia and/or design 26 entirely from inflatable member 22. Inflatable member 22 further includes openings 28 located on opposite side ends of perimeter sides 22A. These openings may be circular in shape and receive sleeve assembly 40. Other embodiments may feature openings 28 of varying shape and sizes to receive additional embodiments of sleeve assembly 40.

Sleeve assembly 40 includes two sleeves 42 which are integrally coupled to inflatable member 22. In one embodiment, two sleeves 42 are provided having a cylindrical shape and mounted in a perpendicular configuration to inflatable member 22. Two sleeves 42 are then in communication with openings 28 of inflatable member 22. Additionally, two sleeves 42 are made of a cloth material. This cloth material may be the same cloth material that is used for inflatable member 22. Other embodiments may feature combinations of cloth materials for two sleeves 42 and inflatable member 22. Furthermore, two sleeves 42 includes an airway opening 44 at a distal end which receives air therein to be transferred into inflatable member 22. These openings 44 may be provided as circular openings. In the present embodiment, two sleeves 42 form a tunnel that is used to transfer air into inflatable member 22 to then effectively inflate inflatable member 22 and accentuate front end 22B.

In one implementation, a user mounts inflatable garment accessory 10 onto an existing piece of clothing 50 by stitching it thereon. As the user preforms a physical activity such as running, natural air then enters airway opening 44 and travels through two sleeves 42. The air then utilizes the tunnel configuration of two sleeves 42 to then be transferred within inflatable member 22. As a result of air entering the inflatable member 22, the inflatable member 22 then enters an inflated state causing the fabric of the inflatable member to stretch and expand. During this expansion, front end 22B of inflatable member 22 is then accentuated. As a result, any indicia and/or design located on front end 22B is also accentuated and put on display to be seen be a large number of individuals. In other embodiments of the present invention, inflatable member 22 may be inflated using an exterior motor that may be provided onto clothing 50. In yet another embodiment, a manual blow hole may be provided onto inflatable member 22 to allow a user to manually blow air within inflatable member 22. In the present embodiment depicted in FIG. 1, it is observed that the garment is mounted to a rear side of the clothing 50. Additionally, the sleeves 42 run underneath an armpit section of the clothing 50. Sleeves 42 are to be positioned such that the airway opening 44 is facing outwardly from the user to receive air therein when the user is riding a motorcycle or any other type of vehicle. The inflatable member 22 will be accentuated as along as the airway openings 44 are exposed to proper airflow. The present garment can be implemented in other clothing and vehicles, not limited to the ones described herein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an inflatable garment accessory, comprising:

a) a body assembly including an inflatable member having an interior space, wherein said inflatable member is made of an inflatable cloth material, said inflatable member having two openings located on opposite sides of said inflatable member;

b) a sleeve assembly including two sleeves coupled to said two openings, said two sleeves forming tunnels which receive air through an air way opening to effectively inflate said inflatable member, the system for the inflatable garment accessory further includes a clothing being at least one of a shirt or a jacket wherein said body assembly is stitched to a rear side of the clothing, the two sleeves are stitched onto lateral side portions of the clothing entirely underneath an armpit section such that the air way opening is facing towards a front end of the clothing.

2. The system for an inflatable garment accessory of claim 1 wherein said inflatable member includes a front-end having indicia thereon.

3. The system for an inflatable garment accessory of claim 1 wherein said inflatable member includes a front end having a design thereon.

4. The system for an inflatable garment accessory of claim 1 wherein said inflatable member is an airtight inflatable member.

5. The system for an inflatable garment accessory of claim 1 wherein said two sleeves are mounted in a perpendicular configuration to said inflatable member.

6. The system for an inflatable garment accessory of claim 1 wherein the two sleeves are of the same length.

7. A system for an inflatable garment accessory, comprising:

a) a piece of clothing being a shirt;

b) a body assembly including a main inflatable member having a circular shape with perimeter sides, wherein said main inflatable member is made of a stretchable cloth material, said main inflatable member having an interior space therein, wherein said main inflatable member is an air tight inflatable member, said main inflatable member having a front end, said front end having an indicia and/or design imprinted thereon, said main inflatable member further including circular openings located on opposite sides thereon; and c) a sleeve assembly including two sleeves made of a cloth material coupled to said circular openings, wherein said two sleeves are mounted in a perpendicular configuration to said main inflatable member, said two sleeves having an airway opening located at a distal end, said two sleeves having a cylindrical shape, said two sleeves forming a tunnel which receives air therein to then effectively inflate said main inflatable member.

8. A system for an inflatable garment accessory, consisting of:

a) a piece of clothing being a shirt;

b) a body assembly including a main inflatable member having a circular shape with perimeter sides, wherein said main inflatable member is made of a stretchable cloth material, said main inflatable member having an interior space therein, wherein said main inflatable member is an air tight inflatable member, said main inflatable member having a front end, said front end having an indicia and/or design imprinted thereon, said main inflatable member further including circular openings located on opposite sides thereon; and c) a sleeve assembly including two sleeves made of a cloth material coupled to said circular openings, wherein said two sleeves are mounted in a perpendicular configuration to said main inflatable member, said two sleeves having an airway opening located at a distal end, said two sleeves having a cylindrical shape, said two sleeves forming a tunnel which receives air therein to then effectively inflate said main inflatable member, wherein said body assembly is stitched entirely to a rear side of the shirt, wherein the two sleeves are stitched onto lateral side portions of the shirt entirely underneath an armpit section such that the air way opening is entirely facing towards a front end of the shirt.

* * * * *